US009643249B2

(12) United States Patent
Sun

(10) Patent No.: US 9,643,249 B2
(45) Date of Patent: May 9, 2017

(54) METHOD AND APPARATUS FOR SINTERING NDFEB RARE EARTH PERMANENT MAGNET

(71) Applicant: SHENYANG GENERAL MAGNETIC CO., LTD., Shenyang, Liaoning (CN)

(72) Inventor: Baoyu Sun, Liaoning (CN)

(73) Assignee: SHENYANG GENERAL MAGNETICS CO., LTD, Shenyang, Liaoning (CN)

( * ) Notice: Subject to any disclaimer, the term of this patent is extended or adjusted under 35 U.S.C. 154(b) by 65 days.

(21) Appl. No.: 14/708,497

(22) Filed: May 11, 2015

(65) Prior Publication Data

US 2015/0243434 A1 Aug. 27, 2015

(30) Foreign Application Priority Data

May 11, 2014 (CN) ..... 2014 1 0194945

(51) Int. Cl.

| | |
|---|---|
| ***B22F 3/00*** | (2006.01) |
| ***B22F 5/00*** | (2006.01) |
| ***H01F 41/02*** | (2006.01) |
| ***H01F 1/053*** | (2006.01) |
| ***H01F 1/057*** | (2006.01) |
| ***B22F 9/04*** | (2006.01) |

(Continued)

(52) U.S. Cl.

CPC ..... *B22F 3/003* (2013.01); *C22C 33/0278* (2013.01); *F27B 9/028* (2013.01); *H01F 1/0577* (2013.01); *H01F 41/0273* (2013.01); *B22F 3/24* (2013.01); *B22F 9/04* (2013.01); *B22F 2003/248* (2013.01); *B22F 2998/10* (2013.01); *C22C 2202/02* (2013.01)

(58) Field of Classification Search

None

See application file for complete search history.

(56) References Cited

U.S. PATENT DOCUMENTS 5,071,493 A * 12/1991 Mizoguchi ..... H01F 1/0577 148/302

6,461,565 B2 10/2002 Tokuhara et al.

(Continued)

FOREIGN PATENT DOCUMENTS

| | | |
|---|---|---|
| CN | 1187152 | 2/2005 |
| CN | 1240088 | 2/2006 |

(Continued)

*Primary Examiner* — Jie Yang
*Assistant Examiner* — Xiaowei Su

(57) ABSTRACT

A method for sintering NdFeB rare earth permanent magnet includes steps of: providing a continuous vacuum sintering furnace to sinter; loading a sintering box with compacted magnet blocks onto a loading frame; while driving by a transmission apparatus, sending the loading frame orderly through a preparation chamber, a pre-heating and degreasing chamber, a first degassing chamber, a second degassing chamber, a pre-sintering chamber, a sintering chamber, an aging chamber and a cooling chamber of the continuous vacuum sintering furnace, respectively for pre-heating to remove organic impurities, and further for heating to dehydrogenate and degas, pre-sintering, sintering, aging and cooling. A continuous vacuum sintering apparatus is also provided.

9 Claims, 2 Drawing Sheets

(51) Int. Cl.

| | |
|---|---|
| ***B22F 3/24*** | (2006.01) |
| ***C22C 33/02*** | (2006.01) |
| ***F27B 9/02*** | (2006.01) |

(56) References Cited

U.S. PATENT DOCUMENTS

| | | | | |
|---|---|---|---|---|
| 6,491,765 | B2 | 12/2002 | Okayama et al. | |
| 6,527,874 | B2 | 3/2003 | Li | |
| 6,537,385 | B2 | 3/2003 | Okayama et al. | |
| 2002/0054824 | A1* | 5/2002 | Tokoro | B22F 3/22 419/30 |
| 2013/0049908 | A1* | 2/2013 | Yuan | H01F 41/0266 335/302 |

FOREIGN PATENT DOCUMENTS

| | | |
|---|---|---|
| JP | 63065742 | 12/1988 |
| JP | 08005664 | 1/1996 |

* cited by examiner

METHOD AND APPARATUS FOR SINTERING NDFEB RARE EARTH PERMANENT MAGNET

CROSS REFERENCE OF RELATED APPLICATION

This invention claims priority under 35 U.S.C. 119(a-d) to CN 201410194945.1, filed May 11, 2014.

BACKGROUND OF THE PRESENT INVENTION

Field of Invention

The present invention relates to permanent magnetic devices, and more particularly to a method and an apparatus for sintering a NdFeB rare earth permanent magnet.

Description of Related Arts

The NdFeB rare earth permanent magnetic material is increasingly applied because of its excellent magnetism, and widely applied in medical nuclear magnetic resonance imaging, computer hard disk drives, audio equipment and the mobile phones. Along with the benefits of energy-saving and low-carbon economy, the NdFeB rare earth permanent magnetic material is further applied in auto parts, household appliances, energy-saving control motors, hybrid power vehicles and wind generators.

In 1982, the Japan Sumitomo Special Metals Co., Ltd. initially published the Japanese patent applications, JP 1,622,492 and JP 2,137,496, to disclose the NdFeB rare earth permanent magnetic material, and subsequently submitted the correspondent U.S. patent application and the correspondent European patent application to disclose the features, the constituents and the preparation method thereof, wherein an $Nd_2Fe_{14}B$ phase is confirmed as the main phase; and wherein a rich Nd phase, a rich B phase and rare earth oxide impurities are confirmed as the grain boundary phase.

On Apr. 1, 2007, the Japan Hitachi Metals is merged with the Japan Sumitomo Metals and inherited the rights and obligations licensed by the related patents of NdFeB rare earth permanent magnets of Japan Sumitomo Metals. On Aug. 17, 2012, the Japan Hitachi Metals claimed the owned U.S. patents, comprising U.S. Pat. No. 6,461,565, U.S. Pat. No. 6,491,765, U.S. Pat. No. 6,537,385 and U.S. Pat. No. 6,527,874, for the lawsuit in the United Sates International Trade Commission (ITC).

The Chinese patent CN1187152C disclosed the sintering box for sintering the rare earth permanent magnet and the Chinese patent CN1240088C disclosed the method for preparing the rare earth sintered magnet.

SUMMARY OF THE PRESENT INVENTION

An object of the present invention is to provide a preparation method and apparatus to overcome defects of conventional arts, so as to improve magnetic performance and lower cost.

With the expansion in the application market of NdFeB rare earth permanent magnetic materials, the shortage of the rare earth resources is increasingly severe, especially in the fields of electronic components, energy-saving control electric motors, auto parts, new energy vehicles and wind power generation which needs relatively more heavy rare earth to improve the coercive force. Thus, reducing the usage of the rare earth, especially the usage of the heavy rare earth, is an important issue to be solved. Through exploration, the present invention provides a method for preparing high-performance NdFeB rare earth permanent magnetic devices.

Accordingly, in order to accomplish the above objects, the present invention adopts the following technical solutions.

A method for sintering a NdFeB rare earth permanent magnet comprises steps of: providing a continuous vacuum sintering furnace; loading a sintering box with compacted magnet blocks onto a loading frame; while driving by a transmission apparatus, sending the loading frame orderly through a preparation chamber, a pre-heating and degreasing chamber, a first degassing chamber, a second degassing chamber, a pre-sintering chamber, a sintering chamber, an aging chamber and a cooling chamber of the continuous vacuum sintering furnace, respectively for pre-heating to remove organic impurities, and further for heating to dehydrogenate and degas, pre-sintering, sintering, aging and cooling, wherein a valve is provided between each two neighboring chambers for separation.

Preferably, the step of pre-heating to remove organic impurities is pre-heating to remove the organic impurities at a temperature of 200-400° C.; the step of heating to dehydrogenate and degas is heating to dehydrogenate and degas at a temperature of 400-800° C.; the step of pre-sintering is pre-sintering at a temperature of 900-1025° C.; the step of sintering is sintering at a temperature of 1025-1080° C.; the step of aging is aging at a temperature of 800-950° C.; after the step of aging, the loading frame is sent into the cooling chamber for rapidly cooling by gas.

Preferably, the step of pre-heating to remove organic impurities is pre-heating to remove the organic impurities at a temperature of 200-400° C.; the step of heating to dehydrogenate and degas is heating to dehydrogenate and degas at a temperature of 600-800° C.; the step of pre-sintering is pre-sintering at a temperature of 900-1000° C.; the step of sintering is sintering at a temperature of 1050-1070° C.; the step of aging is aging at a temperature of 900-950° C.; after the step of aging, the loading frame is sent into the cooling chamber for rapidly cooling by gas.

Preferably, the step of pre-sintering is pre-sintering in a vacuum degree higher than 5 Pa; the step of sintering is sintering in a vacuum degree between $5\times10^{-1}$ Pa and $5\times10^{-3}$ Pa.

Preferably, the step of pre-sintering is pre-sintering in a vacuum degree higher than 50 Pa; the step of sintering comprises sintering in a vacuum degree between 50 Pa and 5 Pa, and filling in argon.

Preferably, the loading frame enters a loading chamber before entering the preparation chamber of the continuous vacuum sintering furnace; in the loading chamber, the magnet block after isostatic pressing is de-packaged and loaded into the sintering box; and then the sintering box is loaded onto the loading frame which is sent into the preparation chamber through the valve while driven by the transmission apparatus.

A continuous vacuum sintering apparatus for NdFeB rare earth permanent magnets comprises a continuous vacuum sintering furnace comprising a preparation chamber, a pre-heating and degreasing chamber, a first degassing chamber, a second degassing chamber, a pre-sintering chamber, a sintering chamber, an aging chamber and a cooling chamber, wherein each two neighboring chambers are connected via a first valve and a transmission apparatus is provided through each chamber. A first heater is provided in the preparation chamber; the preparation chamber is connected to a first vacuum unit via a first filter, wherein the first vacuum unit comprises a first Roots vacuum pump, a first mechanical vacuum pump and a second valve. A first cold trap is provided inside the first filter, wherein a temperature of the first cold trap is below −10° C. A second heater and a metal heat shield are provided in the pre-heating and degreasing chamber. The pre-heating and degreasing chamber is connected to a second vacuum unit via a second filter, wherein the second vacuum unit comprises a second Roots vacuum pump, a second mechanical vacuum pump and a third valve. A second cold trap is provided in the second filter, wherein a temperature of the second cold trap is below −10° C. A third heater and a first thermal-preservation shield are provided in the first degassing chamber and the second degassing chamber. The first degassing chamber and the second degassing chamber are connected to a third vacuum unit. The third vacuum unit comprises a first diffusion pump, a third Roots vacuum pump, a third mechanical vacuum pump and a fourth valve. A fourth heater and a second thermal-preservation shield are provided in the pre-sintering chamber, the sintering chamber and the aging chamber. The pre-sintering chamber, the sintering chamber and the aging chamber are respectively connected to fourth vacuum units. Each fourth vacuum unit comprises a second diffusion pump, a fourth Roots vacuum pump, a fourth mechanical vacuum pump and a fifth valve. A heat exchanger and a cooling fan are provided in the cooling chamber. The cooling chamber is connected to a fifth vacuum unit. The fifth vacuum unit comprises a fifth Roots vacuum pump, a fifth mechanical vacuum pump and a sixth valve. The cooling chamber is further connected to a gas introduction system for introducing cooling gas, wherein the cooling gas is argon gas or nitrogen gas.

The preparation chamber, provided with the first heater therein, has a maximal heating temperature of 300° C. The pre-heating and degreasing chamber, provided with the second heater and the metal heat shield therein, has a maximal heating temperature of 500° C. The first degassing chamber and the second degassing chamber, provided with the third heater and the first thermal-preservation shield, has a maximal heating temperature of 800° C. The pre-sintering chamber, the sintering chamber and the aging chamber, provided with the fourth heater and the second thermal-preservation shield, has a maximal heating temperature of 1100° C.

The continuous vacuum sintering furnace further comprises a loading chamber before the preparation chamber. The loading chamber is connected to the preparation chamber via the first valve. The loading chamber is provided with the transmission apparatus and gloves.

Preferably, the transmission apparatus comprises a plurality of rolling shafts under the loading frame. The rolling shafts in the first degassing chamber, the second degassing chamber, the pre-sintering chamber, the sintering chamber and the aging chamber are made of carbon fiber composite materials, wherein the rolling shafts are provided in the first thermal-preservation shield and the second thermal-preservation shield.

A vacuum aging furnace, as a three-cavity vacuum furnace, comprises a pre-heating chamber, a heating chamber and a cooling chamber, wherein pneumatic valves are provided therebetween. A first heater, a first rolling wheel and a first fork are provided in the pre-heating chamber; the pre-heating chamber has a maximal heating temperature of 300° C. Through the first rolling wheel, a loading frame out of the furnace is sent into the pre-heating chamber; after the loading frame is pre-heated, the loading frame is sent into the heating chamber by the first fork. A second heater, a heat shield and a hearth are provided in the heating chamber. The loading frame is provided above the hearth to be heated, wherein a maximal heating temperature is 900° C. A second fork, a second rolling wheel, a heat exchanger and a fan are provided in the cooling chamber; after the loading frame is heated, the loading frame is withdrawn by the second fork of the cooling chamber, from the hearth of the heating chamber to the second rolling wheel of the cooling chamber. After cooling down, the loading frame is sent out of the cooling chamber by the second rolling wheel.

The heating chamber of the vacuum aging furnace is further provided with a partial pressure system for supplying a partial pressure within a range of 40,000-70,000 Pa.

A method for preparing a NdFeB rare earth permanent magnet, comprises steps of: smelting raw materials and obtaining strip-cast alloy flakes; processing the strip-cast alloy flakes with a hydrogen pulverization, powdering by a jet mill and compacting in a magnetic field; under a protection of nitrogen gas, sending magnetic blocks into a continuous vacuum sintering furnace to be sintered; while driving by a transmission apparatus, sending a loading frame filled with the magnetic blocks orderly through a preparation chamber, a pre-heating chamber, a first degassing chamber, a second degassing chamber, a pre-sintering chamber, a sintering chamber, an aging chamber and a cooling chamber of the continuous vacuum sintering furnace, for pre-heating to remove organic impurities, and further for heating to dehydrogenate and degas, pre-sintering, sintering, first aging and cooling; after cooling, extracting the magnetic blocks out of the continuous vacuum sintering furnace and sending the extracted magnetic blocks into a vacuum aging furnace for a second aging at 450-650° C.; after the second aging, rapidly cooling and obtaining sintered NdFeB rare earth permanent magnets; processing the sintered NdFeB rare earth permanent magnets with machining and surface treatment into NdFeB rare earth permanent magnetic devices.

Preferably, the step of sintering comprises: evacuating and then heating; preserving a temperature of 200-500° C. for 2-6 hours; increasing the temperature to 400-1000° C. and preserving the temperature for 5-12 hours; pre-sintering by preserving the temperature of 900-1025° C. for 2-8 hours; sintering by preserving the temperature of 1025-1080° C. for 2-8 hours. After the step of sintering, the first aging is at 800-950° C. and the second aging is at 450-650° C. The step of rapidly cooling comes after the second aging.

Preferably, the step of sending the extracted magnetic blocks into the vacuum aging furnace for the second aging comprises: putting the loading frame onto a rolling cylinder on a furnace platform in front of the vacuum aging furnace; opening a door of the vacuum aging furnace to transmit the loading frame into a pre-heating chamber for pre-heating at 200-300° C.; sending the loading frame into a heating chamber for heating at 450-650° C., by a first fork in the pre-heating chamber; after heating, sending the heated loading frame into a cooling chamber for cooling with gas, by a second fork in the cooling chamber, wherein the gas is argon gas or nitrogen gas.

Preferably, the step of smelting the raw materials and obtaining the strip-cast alloy flakes comprises: firstly heating R—Fe—B-M raw materials up over 500° C. in vacuum; filling in argon gas, and continuing heating to melt and refine the R—Fe—B-M raw materials into a smelt alloy liquid, wherein $T_2O_3$ micro powder is added to the R—Fe—B-M raw materials; thereafter, casting the smelt alloy liquid into a rotating roller with water quenching through an intermediate tundish, and obtaining the alloy flakes by cooling down the rotating roller; wherein R comprises at least one rare earth element, Nd;

M is at least one member selected from a group consisting of Al, Co, Nb, Ga, Zr, Cu, V, Ti, Cr, Ni and Hf;

$T_2O_3$ is at least one member selected from a group consisting of $Dy_2O_3$, $Tb_2O_3$, $Ho_2O_3$, $Y_2O_3$, $Al_2O_3$ and $Ti_2O_3$; and an amount of the $T_2O_3$ micro powder is: $0 \leq T_2O_3 \leq 2\%$.

Further preferably, the amount of the $T_2O_3$ micro powder is: $0 \leq T_2O_3 \leq 0.8\%$.

Preferably, the $T_2O_3$ micro powder comprises at least one of $Al_2O_3$ and $Dy_2O_3$;

further preferably, the $T_2O_3$ micro powder is $Al_2O_3$; and further preferably, the $T_2O_3$ micro powder is $Dy_2O_3$.

Preferably, the step of smelting the raw materials and obtaining the strip-cast alloy flakes comprises: firstly heating R—Fe—B-M raw materials and $T_2O_3$ micro powder up over 500° C. in vacuum; filling in argon gas, and continuing heating to melt the R—Fe—B-M raw materials into an alloy liquid; refining and casting the alloy liquid into a rotating roller with water quenching through an intermediate tundish, and obtaining the alloy flakes by cooling down the rotating roller.

Preferably, the step of processing the strip-cast alloy flakes with the hydrogen pulverization comprises: filling the alloy flakes into a rotary rolling cylinder; evacuating the rotary rolling cylinder and then introducing hydrogen gas therein for the alloy flakes to absorb the hydrogen at 20-300° C.; rotating the rotary rolling cylinder while heating and evacuating to dehydrogenate at a preserved temperature of 500-900° C. for a preserved time of 3-15 hours; after the preserved time, stop heating, removing a heating furnace to cool down the rotary rolling cylinder, and continuing rotating the rotary rolling cylinder and evacuating; spraying the rotary rolling cylinder with water to cool down when the temperature is below 500° C.

Further preferably, the alloy flakes are processed with the hydrogen pulverization by a continuous hydrogen pulverization apparatus. Driven by a transmission apparatus, a sintering box filled with rare earth permanent magnetic alloy flakes orderly enters a hydrogen absorption chamber, a heating and dehydrogenating chamber and a cooling chamber of the continuous hydrogen pulverization apparatus, and then enters a discharging chamber through a discharging valve. The alloy flakes processed with the hydrogen pulverization are introduced out from the sintering box and fall into a storage tank at a bottom of the discharging chamber. The storage tank is sealed and packaged under a protection of nitrogen gas; and the sintering box is extracted out through a discharging door of the discharging chamber, refilled and recycled. The hydrogen absorption chamber has a temperature of 50-350° C. for absorbing hydrogen. The continuous hydrogen pulverization apparatus comprises at least one heating and dehydrogenating chamber; the heating and dehydrogenating chamber has a temperature of 600-900° C. for dehydrogenating. The continuous hydrogen pulverization apparatus comprises at least one cooling chamber.

Further preferably, the continuous hydrogen pulverization apparatus comprises two heating and dehydrogenating chambers, wherein the sintering box successively stays in the two heating and dehydrogenating chambers for 2-6 hours; the continuous hydrogen pulverization apparatus comprises two cooling chambers, wherein the sintering box successively stays in the two cooling chambers, and respectively in each cooling chamber for 2-6 hours.

A certain amount of hydrogen gas is introduced before heating and dehydrogenating are finished.

In some embodiments, to the storage tank is added a lubricant or an antioxidant; then the storage tank is put into a first mixing machine for pre-mixing.

In some embodiments, to the storage tank is added $T_2O_3$ micro powder; then the storage tank is put into a first mixing machine for pre-mixing.

In some embodiments, the method for preparing the NdFeB rare earth permanent magnet further comprises a step of: adding the alloy flakes, which are processed with the hydrogen pulverization, into the first mixing machine for pre-mixing, before the step of powdering by the jet mill, wherein at least one antioxidant and at least one lubricant are added during pre-mixing.

In some embodiments, the method for preparing the NdFeB rare earth permanent magnet further comprises a step of: adding the alloy flakes, which are processed with the hydrogen pulverization, into the first mixing machine for pre-mixing, before the step of powdering by the jet mill, wherein at least one $T_2O_3$ micro powder is added during pre-mixing.

Preferably, the method for preparing the NdFeB rare earth permanent magnet further comprises a step of: adding the alloy flakes, which are processed with the hydrogen pulverization, into the first mixing machine for pre-mixing, before the step of powdering by the jet mill, wherein at least one $T_2O_3$ micro powder selected from a group consisting of $Y_2O_3$, $Al_2O_3$ and $Dy_2O_3$ is added during pre-mixing.

Further preferably, the method for preparing the NdFeB rare earth permanent magnet further comprises a step of: adding the alloy flakes, which are processed with the hydrogen pulverization, into the first mixing machine for pre-mixing, before the step of powdering by the jet mill, wherein the $Y_2O_3$ micro powder is added during pre-mixing.

Further preferably, the method for preparing the NdFeB rare earth permanent magnet further comprises a step of: adding the alloy flakes, which are processed with the hydrogen pulverization, into the first mixing machine for pre-mixing, before the step of powdering by the jet mill, wherein the $Al_2O_3$ micro powder is added during pre-mixing.

Further preferably, the method for preparing the NdFeB rare earth permanent magnet further comprises a step of: adding the alloy flakes, which are processed with the hydrogen pulverization, into the first mixing machine for pre-mixing, before the step of powdering by the jet mill, wherein the $Dy_2O_3$ micro powder is added during pre-mixing.

The step of powdering by the jet mill, under a protection of nitrogen gas, comprises steps of: firstly filling powder obtained from the hydrogen pulverization, after mixing, into a hopper of a feeder; adding the powder into a grinder by the feeder; grinding the powder via a high-speed gas flow which is ejected by a nozzle; sending the ground powder into a centrifugal sorting wheel via the gas flow to select the powder; sending rough powder beyond a required particle size to the grinder under a centrifugal force to continue grinding, and fine powder below the required particle size which are selected out by the centrifugal sorting wheel into a cyclone collector for collecting; receiving and collecting, by a post cyclone collector, the fine powder which are discharged out along with the gas flow from a gas discharging pipe of the cyclone collector; compressing, by a compressor, and cooling, by a cooler, the gas which is discharged from the post cyclone collector; and sending the compressed and cooled gas into an inlet pipe of the nozzle for recycling the nitrogen.

Preferably, the fine powder which is received and collected by the cyclone collector is collected into a powder mixer which is provided at a bottom of the cyclone collector, through a first valve which opens and closes alternately; the fine powder which is received and collected by the post cyclone collector is also collected into the powder mixer which is provided at the bottom of the cyclone collector, through a second valve which opens and closes alternately; the fine powder is mixed within the powder mixer and then fed into a depositing tank.

The powder collected by the cyclone collector and the powder collected by the post cyclone collector are introduced into the depositing tank through a depositing apparatus.

In some embodiments, the powder which is received and collected by the post cyclone collector is collected through between 2 and 6 post cyclone collectors which are connected in parallel.

In some embodiments, the fine powder which is received and collected by the post cyclone collector is collected through 4 post cyclone collectors which are connected in parallel.

In some embodiments, the powder obtained by the step of powdering by the jet mill is sent into a second mixing machine for post-mixing, which generates the powder having an average particle size of 1.6-2.9 μm.

In some embodiments, the powder obtained by the step of powdering by the jet mill is sent into a second mixing machine for post-mixing, which generates the powder having an average particle size of 2.1-2.8 μm.

The step of compacting in the magnetic field comprises steps of: loading the NdFeB rare earth permanent magnetic alloy powder into a sealed magnetic field compressor under a protection of nitrogen gas, at a powder loading position; under the protection of the nitrogen, in the sealed magnetic field compressor, sending a weighed load into a mold cavity of an assembled mold; then providing a seaming chuck into the mold cavity, and sending the mold into an orientation space of an electromagnet, wherein the alloy powder within the mold is processed with pressure adding and pressure holding, within an orientation magnetic field region; demagnetizing magnetic blocks, and thereafter, resetting a hydraulic cylinder; sending the mold back to the powder loading position, opening the mold to retrieve the magnetic block and packaging the magnetic block with a plastic or rubber cover; then reassembling the mold and repeating the previous steps; putting the packaged magnetic block into a load plate, and extracting out the packaged magnetic blocks from the orientation magnetic field compressor in batches; and sending the extracted magnetic block into an isostatic pressing apparatus for isostatic pressing.

The step of compacting in the magnetic field comprises semi-automatically compacting in the magnetic field and automatically compacting in the magnetic field.

In some embodiments, semi-automatically compacting in the magnetic field comprises steps of: inter-communicating a tank filled with the NdFeB rare earth permanent magnetic alloy powder with a feeding inlet of an orientation magnetic field automatic compressor under a protection of nitrogen gas; discharging air between the tank and a valve of the feeding inlet of a semi-automatic compressor; then opening the valve of the feeding inlet to introduce the powder within the tank into a hopper of a weighing batcher; after weighing, automatically sending the powder into a mold cavity by a powder sender; after removing the powder sender, moving an upper pressing tank of the compressor downward into the mold cavity for magnetizing and orienting the powder, wherein the powder is compressed and compacted in a magnetic field to form a compacted magnet block; demagnetizing the compacted magnet block, and then ejecting the compacted magnet block out of the mold cavity; sending the compacted magnet block into a load platform within the orientation magnetic field automatic compressor under the protection of nitrogen; packaging the compacted magnet block with plastic or rubber cover via gloves to create a packaged magnet block; sending the packaged magnet block into a load plate for a batch output, and then isostatic pressing the packaged magnet block by an isostatic pressing apparatus.

In some embodiments, the step of isostatic pressing the packaged magnet block comprises sending the packaged magnet block into a high-pressure cavity of the isostatic pressing apparatus, wherein an internal space of the high-pressure cavity except the packaged magnet block is full of hydraulic oil; sealing and then compressing the hydraulic oil within the high-pressure cavity, wherein the hydraulic oil is compressed with a pressure of 150-300 MPa; decompressing, and then taking out the magnet block.

Preferably, the isostatic pressing apparatus has two high-pressure cavities, wherein a first one is sleeved out of a second one, in such a manner that the second one is an inner cavity and the first one is an outer cavity. The step of isostatic pressing the packaged magnet block comprises sending the packaged magnet block into the inner cavity of the isostatic pressing apparatus, wherein an internal space of the inner cavity except the package magnet block is full of a liquid medium; and filling the outer cavity of the isostatic pressing apparatus with the hydraulic oil, wherein the outer cavity is intercommunicated with an apparatus for generating high pressure; a pressure of the hydraulic oil of the outer cavity is transmitted into the inner cavity via a separator between the inner cavity and the outer cavity, in such a manner that the pressure within the inner cavity increases accordingly; and the pressure within the inner cavity is between 150-300 MPa.

In some embodiments, automatically compacting in the magnetic field comprises steps of: inter-communicating a tank filled with the NdFeB rare earth permanent magnetic alloy powder with a feeding inlet of an orientation magnetic field automatic compressor under a protection of nitrogen gas; thereafter, discharging air between the tank and a valve of the feeding inlet of the automatic compressor; then opening the valve of the feeding inlet to introduce the powder within the tank into a hopper of a weighing batcher; after weighing, automatically sending the powder into a mold cavity by a powder sender; after removing the powder sender, moving an upper pressing tank of the compressor downward into the mold cavity for magnetizing and orienting the powder, compressing and compacting the powder to form a compacted magnet block; demagnetizing the compacted magnet block, and then ejecting the compacted magnet block out of the mold cavity; sending the compacted magnet block into a box of the orientation magnetic field automatic compressor under the protection of nitrogen; when the box is full, closing the box, and sending the box into a load plate; when the load plate is full, opening a discharging valve of the sealed magnetic field automatic compressor under the protection of nitrogen to transmit the load plate full of the boxes into a transmission sealed box under the protection of nitrogen; and then, under the protection of nitrogen, intercommunicating the transmission sealed box with a protective feeding box of a vacuum sintering furnace to send the load plate full of the boxes into the protective feeding box of the vacuum sintering furnace.

The sealed magnetic field automatic compressor under the protection of nitrogen has electromagnetic pole columns and magnetic field coils which are respectively provided with a cooling medium. The cooling medium is water, oil or refrigerant; and during compacting, the electromagnetic pole columns and the magnetic field coils form a space for containing the mold at a temperature lower than 25° C.

Preferably, the cooling medium is water, oil or refrigerant; during compacting, the electromagnetic pole columns and the magnetic field coils form the space for containing the mold at a temperature lower than 5° C. and higher than −10° C.; and the powder is compressed and compacted at a pressure of 100-300 MPa.

The NdFeB permanent magnet comprises a main phase and a grain boundary phase. The main phase has a structure of $R_2(Fe,Co)_{14}B$, wherein a heavy rare earth HR content of a range extending inwardly by one third from an outer edge of the main phase is higher than the heavy rare earth HR content at a center of the main phase; the grain boundary phase has micro particles of Neodymium oxide; R comprises at least one rare earth element, Nd; HR comprises at least one member selected from a group consisting of Dy, Tb, Ho and Y.

The NdFeB permanent magnet has a metal phase structure that a $ZR_2(Fe_{1-x}Co_x)_{14}B$ phase, having a higher heavy rare earth content than a $R_2(Fe_{1-x}Co_x)_{14}B$ phase, surrounds around $R_2(Fe_{1-x}Co_x)_{14}B$ grains; no grain boundary phase exists between the $ZR_2(Fe_{1-x}Co_x)_{14}B$ phase and the $R_2(Fe_{1-x}Co_x)_{14}B$ phase; the $ZR_2(Fe_{1-x}Co_x)_{14}B$ phase is connected through the grain boundary phase. ZR represents the rare earth of the phase whose heavy rare earth content in the grain phase is higher than a content of the heavy rare earth in an averaged rare earth content; $0 \leq x \leq 0.5$.

The micro particles of Neodymium oxide are provided in the grain boundary phase at boundaries between at least two grains of the $ZR_2(Fe_{1-x}Co_x)_{14}B$ phase of the metal phase of the NdFeB permanent magnet. An oxygen content of the grain boundary is higher than an oxygen content of the main phase.

The grains of the sintered NdFeB permanent magnet, prepared by the method for preparing the sintered NdFeB permanent magnet, have a size of 5-15 μm, preferably 5-9 μm.

During sintering, when the temperature is higher than 500° C., the rich R phase begins to melt gradually; when the temperature is higher than 800° C., kinetic energy of the melting increases and the magnetic block gradually alloys. According to the present invention, while the magnetic block is alloying, the magnetic block undergoes a rare earth diffusion and displacement reaction, wherein the HR elements distributed around the $R_2(Fe_{1-x}Co_x)_{14}B$ phase and the HR elements in the $T_2O_3$ micro powder displace with Nd at the boundary of the $R_2(Fe_{1-x}Co_x)_{14}B$ phase. When the reaction lasts longer, more and more Nd are replaced by HR, which causes the relatively high HR content of the $ZR_2(Fe_{1-x}Co_x)_{14}B$ phase which surrounds around the $R_2(Fe_{1-x}Co_x)_{14}B$ phase, so as to improve the structure of the main phase via surrounding around the $R_2(Fe_{1-x}Co_x)_{14}B$ phase by the $ZR_2(Fe_{1-x}Co_x)_{14}B$ phase. After entering the grain boundary, Nd combines with O as a priority to form minor $Nd_2O_3$ micro particles. The $Nd_2O_3$ micro particles in the grain boundary are able to effectively suppress a grow of the $R_2Fe_{14}B$ phase, especially the $Nd_2O_3$ micro particles at the boundary between at least two grains are able to effectively inhibit a fusion of the grains and restrict an abnormal grow of the grains, so as to greatly improve a coercive force of the magnet. Therefore, the present invention is featured in the $Nd_2O_3$ micro particles at the boundary between at least two grains.

These and other objectives, features, and advantages of the present invention will become apparent from the following detailed description, the accompanying drawings, and the appended claims.

Figure 1:
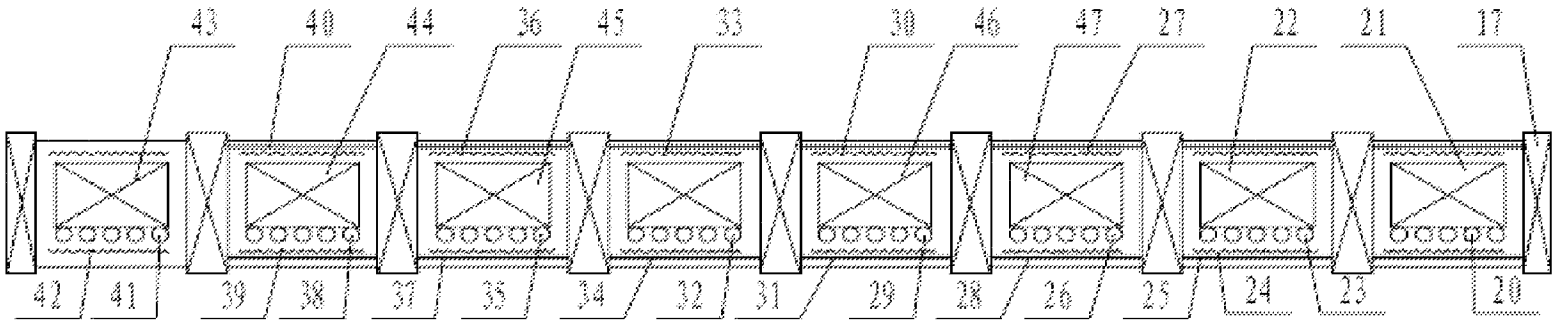
FIG. 1 is a front view of a continuous vacuum sintering apparatus according to preferred embodiments of the present invention.
Figure 2:
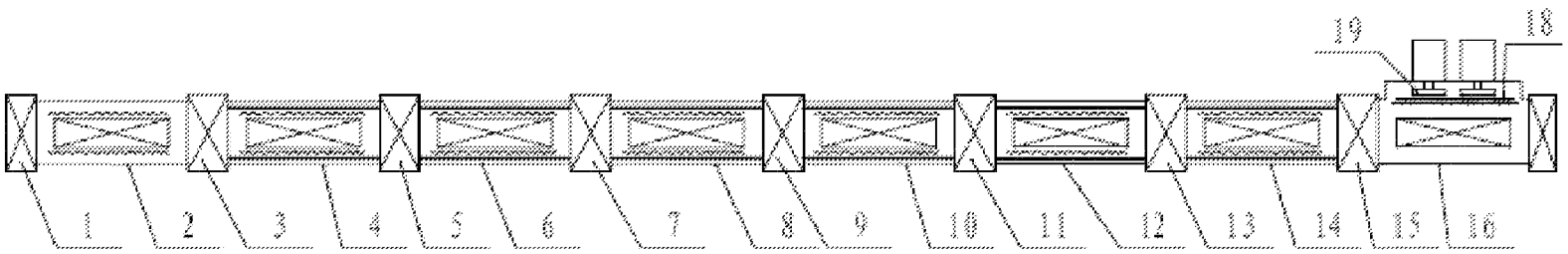
FIG. 2 is a top view of the continuous vacuum sintering apparatus according to the preferred embodiments of the present invention.

1—feeding valve; 2—preparation chamber; 4—pre-heating and degreasing chamber; 6—first degassing chamber; 8—second degassing chamber; 10—pre-sintering chamber; 12—sintering chamber; 14—aging chamber; 16—cooling chamber; 17—discharging door; 3, 5, 7, 9, 11, 13 and 15—valves between chambers; 18—heat exchanger; 19—cooling fan; 20, 23, 26, 29, 32, 35, 38 and 41—rolling shafts; 24, 27, 30, 33, 36, 39 and 42—heaters; 25, 28, 31, 34 and 37—thermal-preservation shields; 40—metal heat shield; 21, 22, 43, 44, 45, 46 and 47—loading frames.

In the drawings, a continuous vacuum sintering apparatus for NdFeB rare earth permanent magnets comprises a feeding valve 1, a preparation chamber 2, a pre-heating and degreasing chamber 4, a first degassing chamber 6, a second degassing chamber 8, a pre-sintering chamber 10, a sintering chamber 12, an aging chamber 14, a cooling chamber 16 and a discharging door 17, wherein each two neighboring chambers are connected via a valve. 3, 5, 7, 9, 11, 13 and 15 are the first valves between each two neighboring chambers. Each chamber is provided with a transmission apparatus which drives rolling shafts to rotate. 20, 23, 26, 29, 32, 35, 38 and 41 are the rolling shafts in each chamber. A first heater 42 is provided in the preparation chamber 2; the preparation chamber 2 is connected to a first vacuum unit via a first filter. The first vacuum unit comprises a first Roots vacuum pump, a first mechanical vacuum pump and a second valve. A first cold trap is provided in the first filter, wherein a temperature of the first cold trap is below −10° C. A second heater 39 and a metal heat shield 40 are provided in the pre-heating and degreasing chamber 4. The pre-heating and degreasing chamber 4 is connected to a second vacuum unit via a second filter. The second vacuum unit comprises a second Roots vacuum pump, a second mechanical vacuum pump and a third valve. A second cold trap is provided in the second filter, wherein the temperature of the second cold trap is below −10° C. A third heater 36 and a first thermal-preservation shield 37 are provided in the first degassing chamber 6; the first degassing chamber 6 is connected to a third vacuum unit. The third vacuum unit comprises a first diffusion pump, a third Roots vacuum pump, a third mechanical vacuum pump and a fourth valve. A fourth heater 33 and a second thermal-preservation shield 34 are provided in the second degassing chamber 8. The second degassing chamber 8 is connected to a fourth vacuum unit which comprises a second diffusion pump, a fourth Roots vacuum pump, a fourth mechanical vacuum pump and a fifth valve. A fifth heater 30 and a third thermal-preservation shield 31 are provided in the pre-sintering chamber 10. The pre-sintering chamber 10 is connected to a fifth vacuum unit which comprises a third diffusion pump, a fifth Roots vacuum pump, a fifth mechanical pump and a sixth valve. A sixth heater 27 and a fourth thermal-preservation shield 28 are provided in the sintering chamber 12. The sintering chamber 12 is connected to a sixth vacuum unit which comprises a fourth diffusion pump, a sixth Roots vacuum pump, a sixth mechanical vacuum pump and a seventh valve. A seventh heater 24 and a fifth thermal-preservation shield 25 are provided in the aging chamber 14. The aging chamber 14 is connected to a seventh vacuum unit which comprises a fifth diffusion pump, a seventh Roots vacuum pump, a seventh mechanical vacuum pump and an eighth valve. A heat exchanger 18 and a cooling fan 19 are provided in the cooling chamber 16; the cooling chamber 16 is connected to an eighth vacuum unit which comprises an eighth Roots vacuum pump, an eighth mechanical vacuum pump and a ninth valve. The cooling chamber is further connected to a gas introduction system for introducing cooling gas, wherein the cooling gas is argon gas or nitrogen gas. 21, 22, 43, 44, 45, 46 and 47 are loading frames.

DETAILED DESCRIPTION OF THE PREFERRED EMBODIMENT

The present invention is further illustrated through following embodiments.

Embodiment 1

600 Kg of an alloy of $Nd_{30}Dy_1Co_{1.2}Cu_{0.1}B_{0.9}Al_{0.1}Fe_{rest}$ was heated to melt, and then added with $Dy_2O_3$ micro powder. The alloy at a melt state was cast onto a rotating copper roller with water quenching, and cooled to form alloy flakes. The alloy flakes were processed with hydrogen pulverization by a continuous vacuum hydrogen pulverization furnace of the present invention, wherein the R—Fe—B-M alloy flakes were firstly loaded into a hanging load bucket, and then sent orderly into a hydrogen absorption chamber, a heating and dehydrogenating chamber and a cooling chamber of the continuous hydrogen pulverization furnace, respectively for absorbing hydrogen, heating to dehydrogenate and cooling. Then, in a protective atmosphere, the alloy after the hydrogen pulverization was loaded into a storage tank and mixed. After mixing, the mixture was powdered by a jet mill having two post cyclone collectors under a protection of nitrogen gas, wherein an atmosphere oxygen content of the jet mill was 0-50 ppm. Powder collected by a cyclone collector and fine powder collected by the two post cyclone collectors were collected in a depositing tank, next mixed by a mixing apparatus under a protection of nitrogen gas, and then oriented and compacted by a sealed magnetic field compressor, under the protection of nitrogen gas, into compacted magnet block. A protective box having an oxygen content of below 190 ppm, an orientation magnetic field intensity of 1.8 T, and a mold cavity inner temperature below 3° C. was provided. The compacted magnet block had a size of 62×52×42 mm, and was oriented at a direction of the 42 mm; the compacted magnet block was sealed into the protective box. Then, the compacted magnet block was extracted out of the protective box for an isostatic pressing at an isostatic pressure of 150-180 MPa, and then sintered and aged. The compacted magnet block was sintered by a continuous vacuum sintering furnace of the present invention, wherein a sintering box filled with the compacted magnet block was put on a loading frame; driven by a transmission apparatus, the loading frame orderly enters a preparation chamber, a pre-heating and degreasing chamber, a first degassing chamber, a second degassing chamber, a pre-sintering chamber, a sintering chamber, an aging chamber and a cooling chamber of the continuous vacuum sintering furnace, for preheating to remove organic impurities, and further for heating to dehydrogenate and degas, pre-sintering, sintering, first aging and cooling. Then the loading frame was extracted out of the sintering furnace and sent into a vacuum aging furnace of the present invention for a second aging, so as to obtain sintered NdFeB permanent magnet. The sintered NdFeB permanent magnet was machined into blocks of 50×30×20 mm; and the blocks were electroplated to form rare earth permanent magnetic devices. Table 1 shows test results of the embodiment 1.

Embodiment 2

600 Kg of an alloy of $Nd_{30}Dy_1Co_{1.2}Cu_{0.1}B_{0.9}Al_{0.1}Fe_{rest}$ was heated to melt. The alloy at a melt state was cast onto a rotating copper roller with water quenching, and cooled to form alloy flakes. The alloy flakes were processed with hydrogen pulverization by a vacuum hydrogen pulverization furnace of the present invention, and then mixed while being added with micro powder of $Y_2O_3$ and a lubricant. After mixing, the mixture was powdered by a jet mill having three post cyclone collectors under a protection of nitrogen gas, wherein an atmosphere oxygen content of the jet mill was 0-40 ppm. Powder collected by a cyclone collector and fine powder collected by the three post cyclone collectors were collected in a depositing tank, next mixed by a mixing apparatus under the protection of nitrogen gas, and then oriented and compacted by a sealed magnetic field semi-automatic compressor under the protection of nitrogen gas into compacted magnet block. A protective box having an oxygen content of below 150 ppm, an orientation magnetic field intensity of 1.5 T, and a mold cavity inner temperature below 4° C. was provided. The compacted magnet block had a size of 62×52×42 mm, and was oriented at a direction of the 42 mm; the compacted magnet block was sealed into the protective box. Then, the compacted magnet block was extracted out of the protective box for an isostatic pressing at an isostatic pressure of 185-195 MPa, and then sintered and aged. The compacted magnet block was sintered by a continuous vacuum sintering furnace of the present invention, wherein a sintering box filled with the compacted magnet block was put on a loading frame; driven by a transmission apparatus, the loading frame orderly enters a preparation chamber, a pre-heating and degreasing chamber, a first degassing chamber, a second degassing chamber, a pre-sintering chamber, a sintering chamber, an aging chamber and a cooling chamber of the continuous vacuum sintering furnace, for preheating to remove organic impurities, and further for heating to dehydrogenate and degas, pre-sintering, sintering, first aging and cooling. Then the loading frame was extracted out of the sintering furnace and sent into a vacuum aging furnace of the present invention for a second aging, so as to obtain sintered NdFeB permanent magnet. The sintered NdFeB permanent magnet was machined into blocks of 50×30×20 mm; and the blocks were electroplated to form rare earth permanent magnetic devices. The table 1 shows test results of the embodiment 2.

Embodiment 3

600 Kg of an alloy of $Nd_{30}Dy_1Co_{1.2}Cu_{0.1}B_{0.9}Al_{0.1}Fe_{rest}$ was heated to melt. The alloy at a melt state was cast onto a rotating copper roller with water quenching, and cooled to form alloy flakes. The alloy flakes were processed with hydrogen pulverization by a vacuum hydrogen pulverization furnace of the present invention, and mixed while being added with micro powder of $Al_2O_3$. After mixing, the mixture was powdered by a jet mill having four post cyclone collectors under a protection of nitrogen gas, wherein an atmosphere oxygen content of the jet mill was 0-20 ppm. Powder collected by a cyclone collector and fine powder collected by the four post cyclone collectors were collected in a depositing tank, next mixed by a mixing apparatus under the protection of nitrogen gas, and then oriented and compacted by a sealed magnetic field automatic compressor under the protection of nitrogen gas into a compacted magnet block. The compacted magnet block had a size of 62×52×42 mm, and was oriented at a direction of the 42 mm. The compacted magnet block was sintered and aged. The compacted magnet block was sintered by a continuous vacuum sintering furnace of the present invention, wherein a sintering box filled with the compacted magnet block was put on a loading frame; driven by a transmission apparatus, the loading frame orderly enters a preparation chamber, a pre-heating and degreasing chamber, a first degassing chamber, a second degassing chamber, a pre-sintering chamber, a sintering chamber, an aging chamber and a cooling chamber of the continuous vacuum sintering furnace, for preheating to remove organic impurities, and further for heating to dehydrogenate and degas, pre-sintering, sintering, first aging and cooling. Then the loading frame was extracted out of the sintering furnace and sent into a vacuum aging furnace of the present invention for a second aging, so as to obtain sintered NdFeB permanent magnet. The sintered NdFeB permanent magnet was machined into blocks of 50×30×20 mm; and the blocks were electroplated to form rare earth permanent magnetic devices. The table 1 shows test results of the embodiment 3.

Embodiment 4

600 Kg of an alloy of $Nd_{30}Dy_1Co_{1.2}Cu_{0.1}B_{0.9}Al_{0.1}Fe_{rest}$ was heated to melt. The alloy at a melt state was cast onto a rotating copper roller with water quenching, and cooled to form alloy flakes. The alloy flakes were processed with hydrogen pulverization by a vacuum hydrogen pulverization furnace of the present invention, and mixed while being added with micro powder of $Dy_2O_3$. After mixing, the mixture was powdered by a jet mill having five post cyclone collectors under a protection of nitrogen gas, wherein an atmosphere oxygen content of the jet mill was 0-18 ppm. Powder collected by a cyclone collector and fine powder collected by the five post cyclone collectors were collected in a depositing tank, next mixed by a mixing apparatus under the protection of nitrogen gas, and then oriented and compacted by a sealed magnetic field compressor under the protection of nitrogen gas into compacted magnet block. A protective box having an oxygen content of 0-90 ppm, an orientation magnetic field intensity of 1.9 T, and a mold cavity inner temperature of 0-25° C. was provided. The compacted magnet block had a size of 62×52×42 mm, and was oriented at a direction of the 42 mm; the compacted magnet block was sealed into the protective box. Then, the compacted magnet block was extracted out of the protective box for an isostatic pressing at an isostatic pressure of 240-300 MPa, and then sintered and aged. The compacted magnet block was sintered by a continuous vacuum sintering furnace of the present invention, wherein a sintering box filled with the compacted magnet block was put on a loading frame; driven by a transmission apparatus, the loading frame orderly enters a preparation chamber, a pre-heating and degreasing chamber, a first degassing chamber, a second degassing chamber, a pre-sintering chamber, a sintering chamber, an aging chamber and a cooling chamber of the continuous vacuum sintering furnace, for preheating to remove organic impurities, and further for heating to dehydrogenate and degas, pre-sintering, sintering, first aging and cooling. Then the loading frame was extracted out of the sintering furnace and sent into a vacuum aging furnace of the present invention for a second aging, so as to obtain sintered NdFeB permanent magnet. The sintered NdFeB permanent magnet was machined into blocks of 50×30×20 mm; and the blocks were electroplated to form rare earth permanent magnetic devices. The table 1 shows test results of the embodiment 4.

Embodiment 5

600 Kg of an alloy of $Nd_{30}Dy_1Co_{1.2}Cu_{0.1}B_{0.9}Al_{0.1}Fe_{rest}$ was heated to melt. The alloy at a melt state was cast onto a rotating copper roller with water quenching, and cooled to form alloy flakes. The alloy flakes were processed with hydrogen pulverization by a vacuum hydrogen pulverization furnace of the present invention, and then powdered by a jet mill having six post cyclone collectors under a protection of nitrogen gas, wherein an atmosphere oxygen content of the jet mill was 0-20 ppm. Powder collected by a cyclone collector and fine powder collected by the six post cyclone collectors were collected in a depositing tank, next mixed by a mixing apparatus under the protection of nitrogen gas, and then oriented and compacted by a sealed magnetic field compressor under the protection of nitrogen gas into compacted magnet block. A protective box having an oxygen content of 10-150 ppm, an orientation magnetic field intensity of 1.6 T, and a mold cavity inner temperature of 6-14° C. was provided. The compacted magnet block had a size of 62×52×42 mm, and was oriented at a direction of the 42 mm; the compacted magnet block was sealed into the protective box. Then, the compacted magnet block was extracted out of the protective box for an isostatic pressing at an isostatic pressure of 26-280 MPa, and then sintered and aged. The compacted magnet block was sintered by a continuous vacuum sintering furnace of the present invention, wherein a sintering box filled with the compacted magnet block was put on a loading frame; driven by a transmission apparatus, the loading frame orderly enters a preparation chamber, a pre-heating and degreasing chamber, a first degassing chamber, a second degassing chamber, a pre-sintering chamber, a sintering chamber, an aging chamber and a cooling chamber of the continuous vacuum sintering furnace, for preheating to remove organic impurities, and further for heating to dehydrogenate and degas, pre-sintering, sintering, first aging and cooling. Then the loading frame was extracted out of the sintering furnace and sent into a vacuum aging furnace of the present invention for a second aging, so as to obtain sintered NdFeB permanent magnet. The sintered NdFeB permanent magnet was machined into blocks of 50×30×20 mm; and the blocks were electroplated to form rare earth permanent magnetic devices. The table 1 shows test results of the embodiment 5.

Contrast

600 Kg of an alloy of $Nd_{30}Dy_1Co_{1.2}Cu_{0.1}B_{0.9}Al_{0.1}Fe_{rest}$ was heated to melt. The alloy at a melt state was cast onto a rotating quenching roller with water quenching, and cooled to form alloy flakes. The alloy flakes were roughly pulverized by a conventional vacuum hydrogen pulverization furnace, then powdered by a conventional jet mill, and then oriented and compacted by a conventional magnetic field compressor under a protection of nitrogen into compacted magnet block. The compacted magnet block had a size of 62×52×42 mm, and was oriented at a direction of the 42 mm; the compacted magnet block was sealed into a protective box. Then, the compacted magnet block was extracted out of the protective box for an isostatic pressing at an isostatic pressure of 210 MPa, sintered and aged, so as to obtain sintered NdFeB permanent magnet. Then the sintered NdFeB permanent magnet was machined into blocks of 50×30×20 mm; and then, the blocks are electroplated to form rare earth permanent magnetic device.

TABLE 1

Performance Test Results of Embodiments and Contrast

| Order | Number | Oxide micro power content (%) | Magnetic energy product (MGOe) | Coercive force (KOe) | Magnetic energy product (MGOe) + coercive force (KOe) | Weightlessness (g/cm$^2$) |
|---|---|---|---|---|---|---|
| 1 | Embodiment 1 | 0.1 | 48.8 | 23.4 | 72.2 | 4.1 |
| 2 | Embodiment 2 | 0.2 | 48.2 | 23.2 | 71.4 | 3.2 |
| 3 | Embodiment 3 | 0.3 | 47.5 | 23.8 | 71.1 | 2.8 |
| 4 | Embodiment 4 | 0.1 | 48.6 | 23.1 | 71.7 | 3.6 |
| 5 | Embodiment 5 | 0 | 48.3 | 22.6 | 70.9 | 3.4 |
| 6 | Contrast | 0 | 47.5 | 17.8 | 65.3 | 7.5 |

By a comparison between the embodiments and the contrast, the method and the apparatus of the present invention greatly improve magnetism and corrosion resistance of the magnets, and thus have a great development prospect.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for sintering NdFeB rare earth permanent magnets comprising steps of:

providing a continuous vacuum sintering furnace;

loading a sintering box with compacted NdFeB magnet blocks onto a loading frame;

driving the loading frame orderly by a transmission apparatus through a preparation chamber, a preheating and degreasing chamber, a first degassing chamber, a second degassing chamber, a pre-sintering chamber, a sintering chamber, an aging chamber and a cooling chamber of the continuous vacuum sintering furnace;

wherein a step of pre-heating to remove organic impurities from the compacted magnet blocks is performed at 200-400° C. in the preheating and degreasing chamber; a step of heating to dehydrogenate and degas the compacted magnet blocks is performed at 600-800° C. in the first and second degassing chamber; a step of pre-sintering the compacted magnet blocks is performed at 900-1000° C. in the pre-sintering chamber under a vacuum greater than 5 Pa; a step of sintering is performed at 1050-1070° C. in the sintering chamber under a vacuum between $5\times10^{-1}$ Pa and $5\times10^{-3}$ Pa; a step of aging is performed at 900-950° C. in the aging chamber; then the loading frame is sent to the cooling chamber to be cooled by gas.

2. The method for sintering the NdFeB rare earth permanent magnets, as recited in claim 1, further comprising steps of: sending the loading frame into a loading chamber before into the preparation chamber of the continuous vacuum sintering furnace; in the loading chamber, unpacking the compacted NdFeB magnet blocks after isostatic pressing and loading the compacted NdFeB magnet blocks into the sintering box; and then loading the sintering box onto the loading frame which is driven by the transmission apparatus and sent into the preparation chamber through a valve.

3. A method for preparing NdFeB rare earth permanent magnets, comprising steps of:

melting raw materials to form a melt containing NdFeB alloy;

making NdFeB alloy flakes by strip casting;

processing the NdFeB alloy flakes with hydrogen pulverization;

powdering the NdFeB alloy flakes into NdFeB alloy powder by a jet mill;

compacting the NdFeB alloy powder in a magnetic field into compacted NdFeB magnet blocks;

loading a sintering box with the compacted NdFeB magnet blocks onto a loading frame and sending the loading frame filled with the compacted magnet blocks into a continuous vacuum sintering furnace under a protection of nitrogen gas;

sending the load frame filled with the compacted NdFeB magnet blocks through a preparation chamber, a preheating and degreasing chamber, a first degassing chamber, a second degassing chamber, a pre-sintering chamber, a sintering chamber, an aging chamber and a cooling chamber of the continuous vacuum sintering furnace;

wherein a step of pre-heating to remove organic impurities from the compacted magnet blocks is performed at 200-400° C. in the preheating and degreasing chamber; a step of heating to dehydrogenate and degas the compacted magnet blocks is performed at 600-800° C. in the first and second degassing chamber; a step of pre-sintering the compacted magnet blocks is performed at 900-1000° C. in the pre-sintering chamber under a vacuum greater than 5 Pa; a step of sintering is performed at 1050-1070° C. in the sintering chamber under a vacuum between $5\times10^{-1}$ Pa and $5\times10^{-3}$ Pa; a step of first aging is performed at 900-950° C. in the aging chamber; cooling the sintered magnets; after cooling, extracting the loading frame out of the continuous vacuum sintering furnace and sending the loading frame filled with sintered magnets into a vacuum aging furnace for a second aging at a temperature range of 450-650° C. followed by cooling; then processing the sintered NdFeB rare earth permanent magnets with machining and surface treatment.

4. The method for preparing the NdFeB rare earth permanent magnets, as recited in claim 3, before powdering the NdFeB alloy flakes into the powder by the jet mill and after processing the NdFeB alloy flakes with the hydrogen pulverization, further comprising steps of: adding the alloy flakes into a mixing machine for pre-mixing; and adding $T_2O_3$ micro powder during pre-mixing, wherein the $T_2O_3$ comprises at least one member selected from the group consisting of $Y_2O_3$, $Al_2O_3$ and $Dy_2O_3$.

5. The method for preparing the NdFeB rare earth permanent magnets, as recited in claim 3, wherein the step of compacting the NdFeB alloy powder in the magnetic field into the compacted magnet blocks comprises: sending the NdFeB alloy powder into a sealed magnetic field compressor under the protection of nitrogen gas for orienting and compacting the NdFeB alloy powder into the compacted magnet blocks; and wherein the method for preparing the NdFeB rare earth permanent magnets further comprises: packaging the compacted NdFeB magnet blocks and extracting the NdFeB magnet blocks, which are packaged, out of the sealed magnetic field compressor; sending the NdFeB magnet blocks, which are packaged, into an isostatic pressing machine for isostatic pressing; thereafter, sending the NdFeB magnet blocks, which are packaged, into a protective box under the protection of nitrogen gas, and unpacking the magnet blocks under the protection of nitrogen gas; and then, loading the magnet blocks into the sintering box being sent into the continuous vacuum sintering furnace to sinter.

6. The method for preparing the NdFeB rare earth permanent magnets, as recited in claim 3, wherein the NdFeB rare earth permanent magnet comprises a main phase and a grain boundary phase; the main phase has a structure of $R_2(Fe,Co)_{14}B$, wherein a heavy rare earth HR content between the edge of a main phase grain to a location which is ⅓ of the distance from the edge to the center of the main phase grain is higher than a heavy rare earth HR content at the center of the main phase grain; the grain boundary phase has micro particles of neodymium oxide; R comprises at least Nd; and HR is at least one member selected from the group consisting of Dy, Tb, Ho and Y.

7. The method for preparing the NdFeB rare earth permanent magnet, as recited in claim 3, wherein the NdFeB permanent magnet has a metal phase structure comprising a $ZR_2(Fe_{1-x}Co_x)_{14}B$ phase and a $R_2(Fe_{1-x}Co_x)_{14}B$ phase, the $ZR_2(Fe_{1-x}Co_x)_{14}B$ phase surrounds the $R_2(Fe_{1-x}Co_x)_{14}B$ phase and has a higher heavy rare earth content than the $R_2(Fe_{1-x}Co_x)_{14}B$ phase; no grain boundary phase exists between the $ZR_2(Fe_{1-x}Co_x)_{14}B$ phase and the $R_2(Fe_{1-x}Co_x)_{14}B$ phase; wherein ZR represents total rare earth elements of the $ZR_2(Fe_{1-x}Co_x)_{14}B$ phase and the heavy rare earth content in the $ZR_2(Fe_{1-x}Co_x)_{14}B$ phase is higher than an average content of heavy rare earth elements in the NdFeB rare earth permanent magnet $0 \leq x \leq 0.5$.

8. The method for preparing the NdFeB rare earth permanent magnets, as recited in claim 3, wherein micro particles of Neodymium oxide are provided in a grain boundary phase at boundaries between at least two grains of $ZR_2(Fe_{1-x}Co_x)_{14}B$ phase, and an oxygen content of the grain boundary phase is higher than an oxygen content of the main phase of the NdFeB permanent magnet.

9. The method for preparing the NdFeB rare earth permanent magnets, as recited in claim 3, wherein the second aging comprises steps of: putting the loading frame carrying the sintered NdFeB magnets onto a rolling cylinder on a furnace platform in front of the vacuum aging furnace; opening a door of the vacuum aging furnace to transmit the loading frame into a pre-heating chamber for preheating at 200-300° C.; sending the loading frame into a heating chamber for heating at 450-650° C., by a first fork in the pre-heating chamber; after heating, sending the heated loading frame into a cooling chamber for cooling with gas, by a second fork in the cooling chamber, wherein the gas is argon gas or nitrogen gas.

* * * * *